US006263596B1

(12) United States Patent
Pedron et al.

(10) Patent No.: US 6,263,596 B1
(45) Date of Patent: Jul. 24, 2001

(54) IRON COMPRISING TWO HEATING MEANS WITH PARTICULAR AUTOMATIC TEMPERATURE CONTROL MODE

(75) Inventors: Jerome P. Pedron, Heyrieux; Jean-Louis Brandolini, Thurins, both of (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 09/463,193

(22) PCT Filed: Jul. 22, 1998

(86) PCT No.: PCT/FR98/01612

§ 371 Date: Jan. 21, 2000

§ 102(e) Date: Jan. 21, 2000

(87) PCT Pub. No.: WO99/05355

PCT Pub. Date: Feb. 4, 1999

(30) Foreign Application Priority Data

Jul. 22, 1997 (FR) ..... 97 09537

(51) Int. Cl.[7] ..... D06F 75/24
(52) U.S. Cl. ..... 38/77.7; 219/255
(58) Field of Search ..... 38/77.7, 77.83, 38/82, 93, 81, 80, 97; 219/250, 254, 255

(56) References Cited

U.S. PATENT DOCUMENTS

| | | | | |
|---|---|---|---|---|
| 3,110,975 | | 11/1963 | Kircher . | |
| 3,263,350 | * | 8/1966 | Abraham | 38/77.7 |
| 4,939,342 | * | 7/1990 | Frens et al. | 38/82 X |
| 5,042,179 | * | 8/1991 | Van Der Meer | 38/77.83 |
| 5,279,054 | * | 1/1994 | Chasen | 38/77.7 |

FOREIGN PATENT DOCUMENTS

| | | |
|---|---|---|
| 2 727 439 | 5/1996 | (FR) . |
| 1 380 415 | 1/1975 | (GB) . |

* cited by examiner

*Primary Examiner*—Ismael Izaguirre
(74) *Attorney, Agent, or Firm*—Browdy & Neimark

(57) ABSTRACT

An electric steam pressing iron having a hot part composed of a sole plate (1) and an evaporation chamber (2), the hot part of the iron being divided into two thermal zones, a first zone corresponding substantially to the evaporation chamber (2) being provided with a first heating element (3), a second zone corresponding substantially to a portion of the sole plate (1) disposed under the evaporation chamber (2) being provided with a second heating element (4), the first heating means (3) being associated with a regulation device disposed in the first zone, the first heating element being provided to partially assure the heating of the second zone, characterized in that the second heating element (4) is associated with the regulation device (5) of the first zone.

10 Claims, 5 Drawing Sheets

IRON COMPRISING TWO HEATING MEANS WITH PARTICULAR AUTOMATIC TEMPERATURE CONTROL MODE

TECHNICAL FIELD

The present invention relates to the general technical field of appliances designed to smooth a textile article, such as an article of clothing, by subjecting it to the combined action of a thermal treatment, of a mechanical pressing treatment and of a steam treatment.

The present invention concerns an electric pressing iron comprising a hot part constituted by a sole plate and an evaporation chamber for which the temperature control is assured by the intermediary of a heating circuit in thermal communication with a temperature regulation or control device.

The present invention equally concerns a regulation process for an electric steam iron.

PRIOR ART

Steam irons known in the prior art generally include a heating element in thermal communication with an evaporation chamber, for example a molded tubular heating element in the cast part of said chamber, said heating element being associated with regulation means, which are fixed most often on the cast part. This conventional construction presents several drawbacks. When the selected temperature of the regulation means is fixed at a low value, in order to obtain a low sole plate temperature, for the purpose for example of pressing articles made of delicate fabric, not able to withstand high temperatures, the temperature existing in the evaporation chamber is insufficient to evaporate the water introduced into said chamber. This situation is troublesome since it does not permit the benefits of steam production during pressing of delicate articles. When the selected temperature of the regulation means is fixed at a high value, in order to obtain a high sole plate temperature and preferably a substantial steam flow rate, for the purpose for example of pressing durable articles, it is known and indicated by thermography that the part of the sole plate located under the steam chamber is substantially colder than the rest of the surface of the iron, in particular during the evaporation operation. This situation is troublesome since one desires in general that the surface of the sole plate of the iron attain its optimum temperature at the moment when the steam is emitted.

It is known from the document U.S. Pat. No. 3,110,975 to construct a steam pressing iron comprising a hot part composed of a sole plate and an evaporation chamber, the sole plate and the evaporation chamber each forming a thermal zone provided with a heating element associated with regulation means, the sole plate and the evaporation chamber being thermally isolated from one another. During ironing of delicate fabrics, it is then possible to obtain in the evaporation chamber a temperature sufficient for evaporation of the water, while maintaining a sufficiently low sole plate temperature to not harm the article to be ironed.

This form of construction presents the drawback of having two distinct heating means each associated with its own regulation means. It results therefrom that this construction is disadvantageous, and cumbersome, since there are two regulation means and these must be disposed at appropriate locations.

It is known from the document FR 2 727 439 to construct a steam pressing iron comprising a hot part composed of a sole plate and an evaporation chamber, the hot part being divided into at least two thermal zones, each of them being provided with a heating element, a first zone comprising at least one surface corresponding substantially to the evaporation chamber, a second zone corresponding to at least one surface corresponding substantially to the portion of the sole plate situated under the chamber, the heating element of the first zone being associated with a regulation device disposed in said zone, the heating element of the second zone being associated with a regulation device disposed in said zone, the first zone and the second zone being in thermal communication with respect to one another, the heating element associated with the first zone being provided to partially assure the heating of the second zone. During ironing of articles requiring large quantities of steam, the heating element of the second zone permits prevention of the formation of a cold zone of the sole plate under the evaporation chamber. The ironing is then more effective.

This form of construction presents equally the drawback of having two distinct heating zones each associated with its own regulation means. This form of construction is thus costly. In addition, in order to limit the temperature of the sole plate for ironing delicate fabrics, mastery of the thermal transfer between the sole plate and the cast part of the evaporation chamber requires a reduction of the exchange surface between the sole plate and the cast part, which renders difficult the fluid tightness and the mechanical strength of the sole plate.

For all of the reasons set forth previously, the forms of construction cited above are not satisfactory.

SUMMARY OF THE INVENTION

The object of the invention is thus to construct a steam pressing iron permitting pressing, in an effective manner, thick or strong fabrics requiring a substantial steam flow rate, and permitting ironing of delicate fabrics by producing steam without risk of damaging them, all while presenting a simple and economical construction.

Of course, the invention is applied equally to pressing irons having an integrated reservoir, as well as pressing irons having a separate exterior reservoir.

The objects of the invention are achieved by an electric steam pressing iron comprising a hot part composed of a sole plate and an evaporation chamber, the hot part of the iron being divided into two thermal zones, a first zone corresponding substantially to the evaporation chamber being provided with first heating means, a second zone corresponding substantially to a portion of the sole plate disposed under the evaporation chamber being provided with second heating means, the first heating means being associated with a regulation device disposed in said first zone, the first heating means being provided to partially assure the heating of the second zone, characterized in that the second heating means are associated with the regulation device of the first zone.

The iron thus obtained is of a simplified design since it only includes a single regulation device. The power of the second heating means must of course be selected in a manner to not damage the article to be ironed. For the powers of the second heating means chosen in a manner to compensate more than the temperature drop of the sole plate due to the evaporation of the water in the evaporation chamber, this arrangement permits higher sole plate temperatures to be obtained when the water is introduced into the evaporation chamber and thus to better dry articles that are difficult to press requiring a large amount of steam.

Delicate articles requiring lower ironing temperatures not requiring a large amount of steam, the present invention permits to obtain with a less costly construction a control of the heating means particularly adapted to the ironing of different categories of articles.

Advantageously, the second heating means are formed by a flat heating element.

The bulk of the iron is thus substantially reduced, thanks to the small thickness of the flat heating element. In addition, heating of the sole plate is more uniform, the flat heating element providing a heating on a surface.

The objects of the invention are equally achieved by a regulation process for an electric steam pressing iron, comprising a hot part having a sole plate and an evaporation chamber, the hot part of the iron being divided into two thermal zones, a first zone corresponding substantially to the evaporation chamber being provided with first heating means, a second zone corresponding substantially to a portion of the sole plate disposed under the evaporation chamber being provided with second heating means, the first heating means being associated with a regulation device disposed in said first zone, the first heating means being provided to partially assure the heating of the second zone, characterized in that the first heating means and the second heating means are regulated by the regulation device disposed in the first zone.

BRIEF DESCRIPTION OF THE DRAWINGS

Other particularities and advantages will become more readily apparent from a reading of the description given herebelow with reference to the attached drawings given by way of illustrative but non-limiting examples in which.

BEST MANNER OF ACHIEVING THE INVENTION

Figure 1:
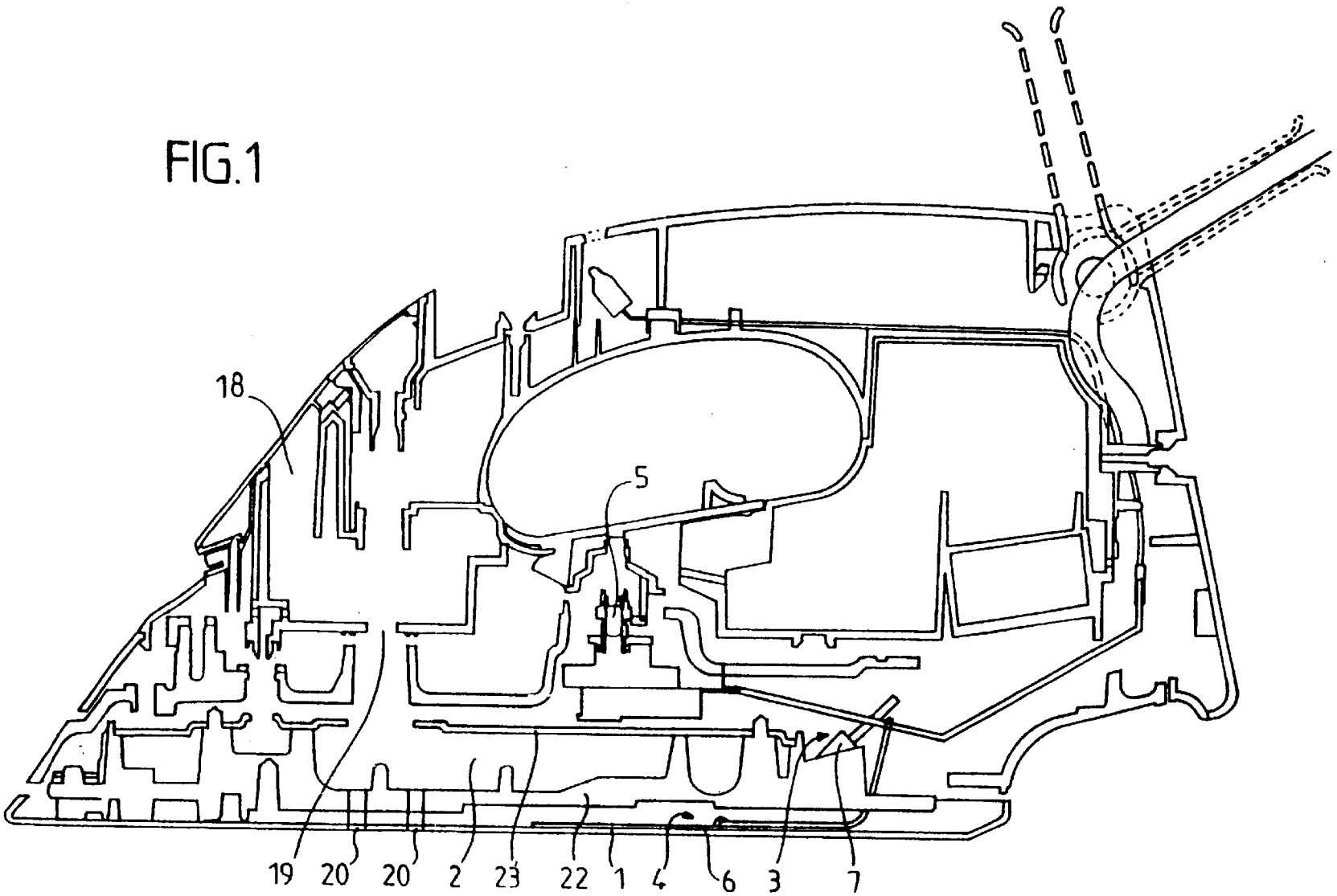
FIG. 1 shows according to a longitudinal cross section a partial view of an example of a form of construction of an iron according to the invention.

An example of construction of an electric steam pressing iron according to the invention is represented in FIG. 1. The iron according to the invention comprises a hot part composed of a sole plate 1 and an evaporation chamber 2. The hot part of the iron is divided into two thermal zones. The first thermal zone corresponds substantially to the evaporation chamber 2, and is provided with first heating means 3. The second thermal zone corresponds substantially to a portion of sole plate 1 disposed under evaporation chamber 2, and is provided with second heating means 4. First heating means 3 are associated with a regulation device 5 disposed in said first zone and are provided to assure particularly the heating of the second zone. As shown in FIG. 1, the evaporation chamber comprises a metal body 22 of a material which is a good conductor of heat, adjoining sole plate 1, on which is added a cover 23. Body 22 is fixed in a known manner to sole plate 1 in a manner to provide a good thermal communication between said sole plate and said chamber. As represented in FIG. 1, regulation device 5 is mounted on cover 23.

According to the invention, heating means 4 and the second zone are associated with regulation device 5 of the first zone. This arrangement is rendered possible by selecting second heating means 4 with an appropriate power and advantageously lower than that of first heating means 3.

Regulation device 5 connects the electric supply to first heating means 3 when the temperature of the first thermal zone, corresponding substantially to the evaporation chamber 2, diminishes. This state occurs infrequently when the iron is utilized dry. It is sufficient to adjust the power of first and second heating means 3; 4 and the calibration of regulation device 5 in order for the temperature of sole plate 1 to be adapted to the fabric corresponding to a given position of the regulation device.

When the iron is utilized in the steam ironing position, water introduced into evaporation chamber 2 contributes to cooling said chamber. Implantation of second heating means 4 under evaporation chamber 2 permits the above-cited temperature drop to be overcome. Since second heating means 4 are fed during the above-cited temperature drop, the risk of burning the ironed fabrics is limited and even avoided by selecting an appropriate power for said second heating means 4, for example from 70 to 200 W.

When the user desires additional steam, he increases the admission of water into evaporation chamber 2. Regulation device 5 responds to the temperature reduction following the admission of water, and acts in an expected manner on the energy supply of first heating means 3 associated with evaporation chamber 2. The response of regulation device 5 acts in a less expected manner on second heating means 4 associated with sole pate 1. Second heating means 4 regulated by device 5 are in effect further supplied with energy when water is admitted into evaporation chamber 2. It follows therefrom that if second heating means 4 have sufficient power, for example greater than 70 W, the supply of energy thereto permits compensation of the temperature drop occurring on the sole plate, following the admission of water into evaporation chamber 2. Thus, the mode of controlling the heating means in dependence on a particular temperature permits obtaining higher sole plate temperatures than in the case of dry operation for the same regulation of regulation device 5, when water is admitted into evaporation chamber 2, and that much higher is a large amount of water is admitted into said chamber. This arrangement is desirable since when an article is difficult to iron and requires a great deal of steam, the higher temperature of sole plate 1 will permit better drying of said article. Of course, the power of second heating means 4 must be selected in a manner to not damage the article to be ironed. A value of 200 W permits an acceptable limit to be maintained.

Advantageously, second heating means 4 are formed by a flat heating element 6, such as represented in FIGS. 1, 2*a*, 2*b* and 2*c*. Such a heating element has a lower thermal inertia than tubular or sheathed heating elements. This characteristic permits simplifying the regulation since the temperature peak in the second zone is achieved shortly after or even during cut-off of the electric supply by regulation device 5. In addition, flat heating element 6 heats a surface in a substantially homogeneous manner, if such a configuration is desired, or can be easily designed in a manner to supply calories into the zone the most affected by the temperature drop. This element preferably occupies a relative surface area of ⅙ to ⅔ of the total surface area of the sole plate. Of course, several flat heating elements 6 can be connected together in series, or in parallel, or according to any combination of these two modes, in a manner to construct the desired thermal map, without for that matter departing from the framework of the invention.

Advantageously, first heating means 3 are formed by a tubular heating element 7, molded into the cast part forming body 22 of evaporation chamber 2, such as represented in FIG. 1. The power of this element is preferably comprised between 1000 and 2000 W.

Figure 2A:
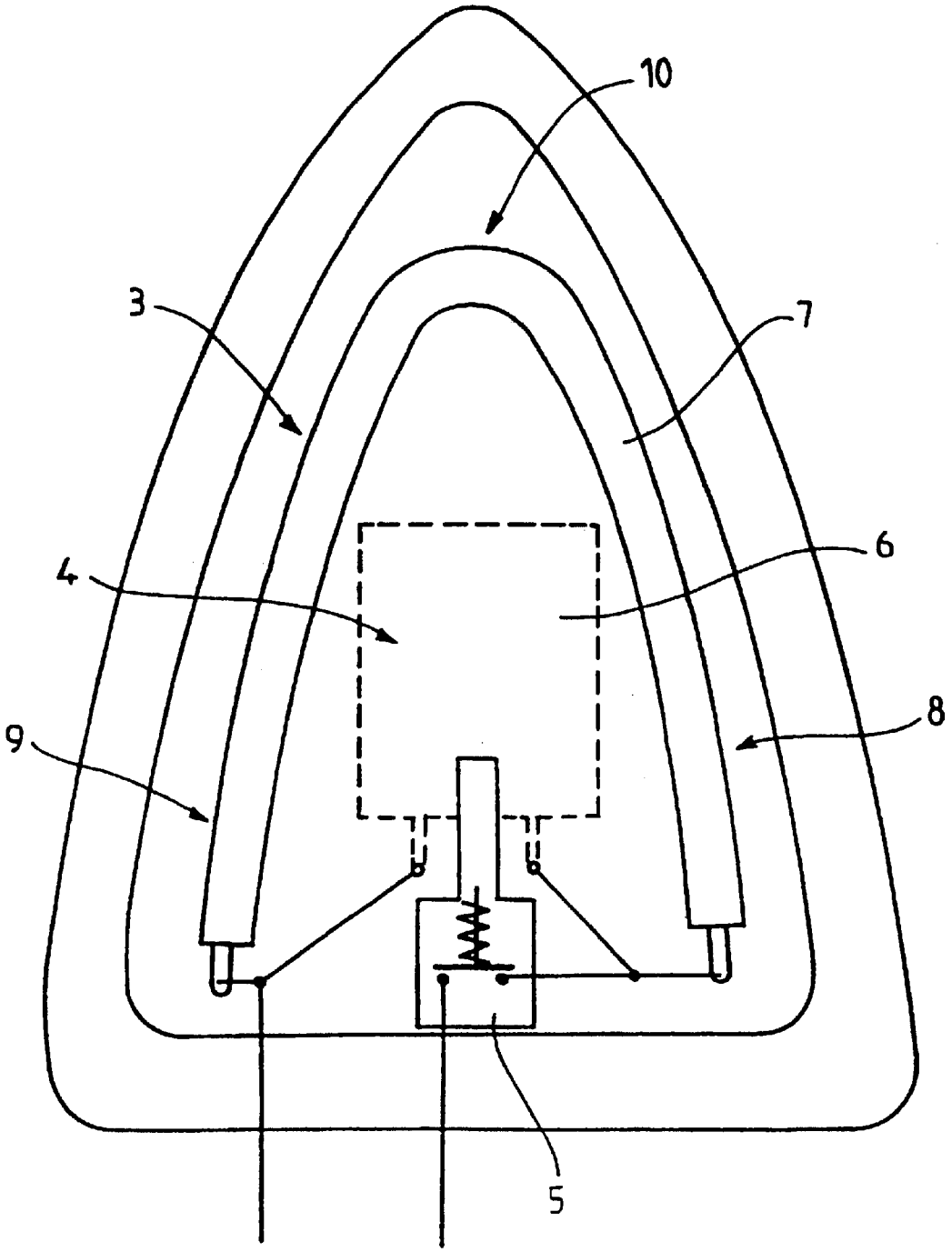
FIG. 2*a* shows a top schematic view in longitudinal cross section of an example of a form of construction of an iron according to the invention.

According to an advantageous arrangement of the present invention represented in FIG. 2*a*, tubular heating element 7, forming first heating means 3, has two substantially parallel branches 8, 9 connected by an elbow 10 and between which flat heating element 6 substantially extends.

Figure 2B:
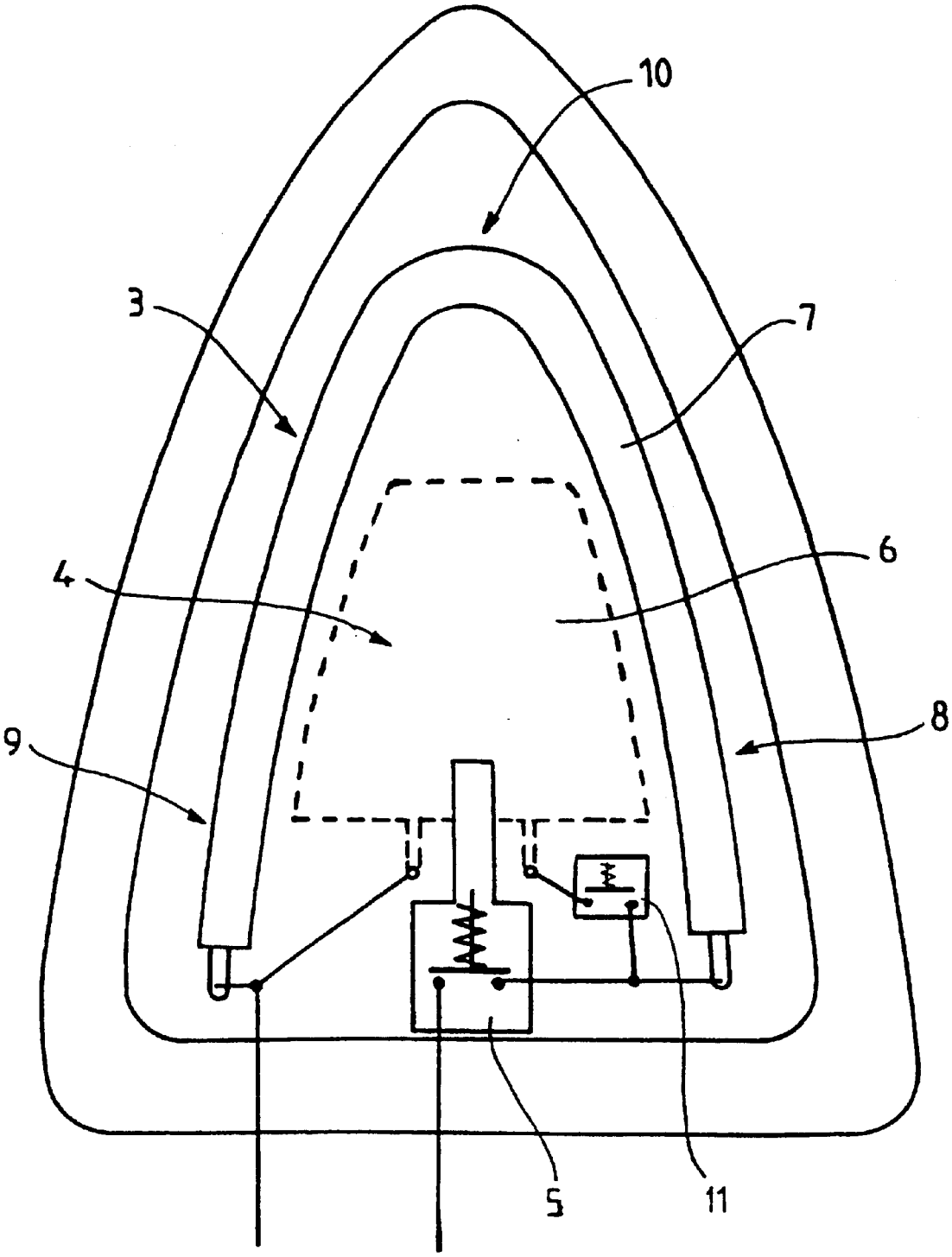
FIG. 2*b* shows a top schematic view according to a longitudinal cross section of a variant of an example of construction of an iron according to the invention.
Figure 2C:
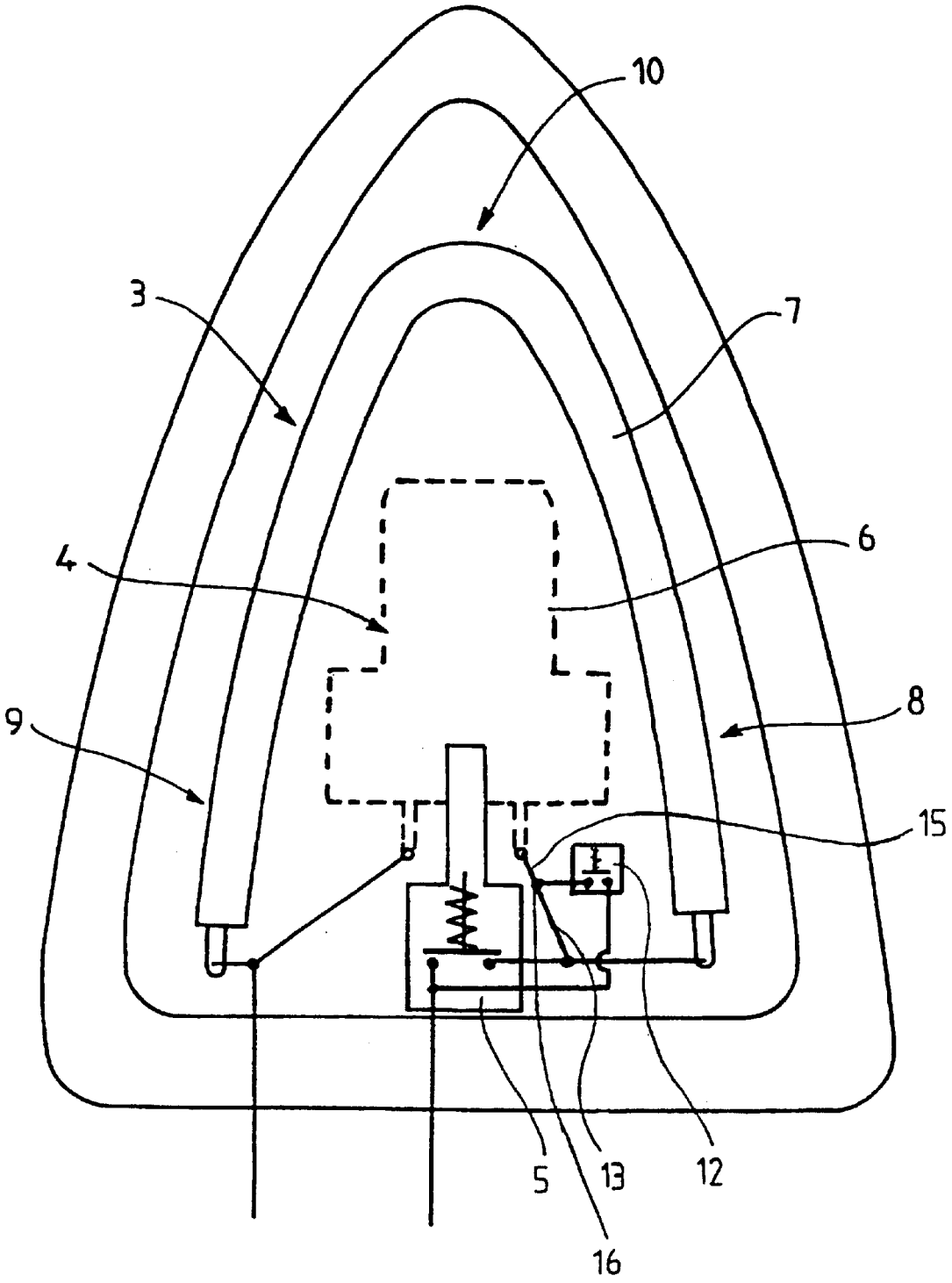
FIG. 2*c* shows a top schematic view according to a longitudinal cross section of another variant of an example of construction of an iron according to the invention.

The geometry of flat heating element 6 is not in any way limited to the rectangular form represented in FIG. 2*a*, but can take other forms. FIG. 2*b* shows a flat heating element having a geometry according to at least in part the form of branches 8, 9 of tubular heating element 7. FIG. 2*c* shows a flat heating element, the geometry of which follows at least partially the form of the bottom of the evaporation chamber.

FIG. 2*a* shows first heating means 3 and second heating means 4 mounted in parallel and associated with regulation device 5 disposed in the first thermal zone.

FIG. 2*b* equally shows first heating means 3 and second heating means 4 mounted in parallel and associated with regulation device 5 disposed in the first thermal zone. First control means 11 permit disconnection of second heating means 4. Such an arrangement is desirable particularly for ironing very delicate fabrics since it permits a better mastery of the sole plate temperature.

FIG. 2*c* equally shows first heating means 3 and second heating means 4 mounted in parallel and associated with regulation device 5 disposed in the first thermal zone. Second control means 12 permit short circuiting of regulation device 5 for second heating means 4. An electric connection 13 mounted between second heating means 4 and regulation device 5 permits control of second heating means 4 by regulation device 5 when second control means are not in an active position forcing supply of power to second heating means 4.

By way of a variation, it is possible to provide first control means 11 (not shown in FIG. 2*c*) on electric connection 13 or on a main electric connection 15 connecting second heating means 4 to a point 16 to which are connected connection 13 and second control means 12. One or the other of these electric schemes can be utilized in the iron shown in FIG. 3.

First heating means 3 and second heating means 4 shown in FIGS. 2*a* and 2*b* are mounted in parallel. By way of a variation, it is possible to envision a mounting in series of first and second heating means 3, 4. The mounting of control means 11 of second heating means 4 should in this case be modified to short circuit said means 4 instead of disconnecting them.

First control means 11 provided to disconnect second heating means 4 and second control means 12 provided for forcing the supply of power to second heating means 4 can be controlled directly or indirectly by the user.

Figure 3:
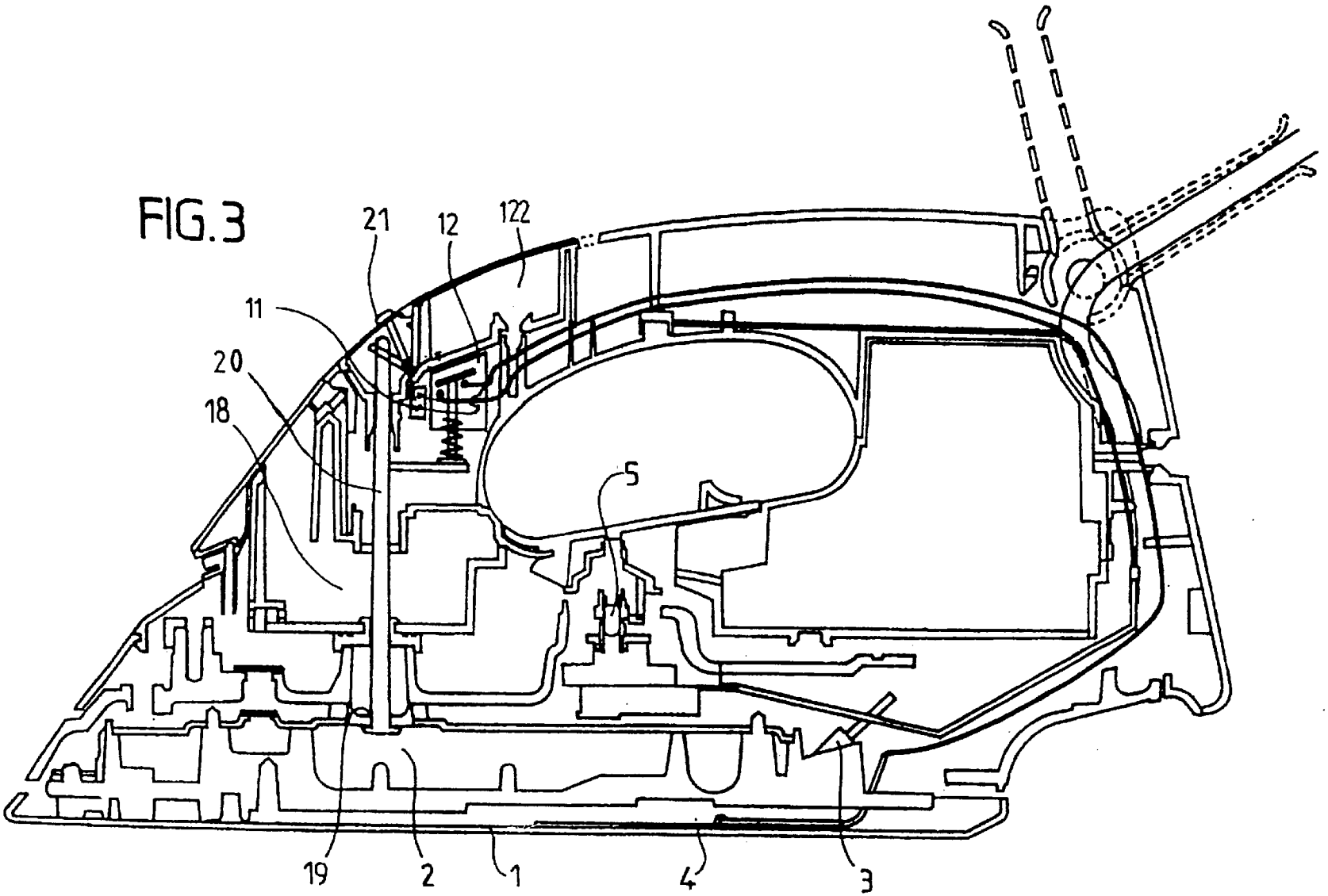
FIG. 3 shows a schematic view of another example of construction of an iron according to the invention.

The iron represented in a schematic manner in FIG. 3 includes an evaporation key 122 provided to be actuated by the user. Evaporation key 122 controls a shaft 20 permitting opening of an orifice 19 provided to place a water reservoir 18 in communication with evaporation chamber 2.

The iron shown in a schematic manner in FIG. 3 includes equally an ironing selector 21 provided to be actuated by the user and cooperating with first control means 11. Selector 21 is capable of occupying a dry ironing position in which first control means 11 deactivate second heating means 4, and at least one steam ironing position, in which second heating means are capable of being supplied with power.

Advantageously, selector 21 is capable of occupying a heavy steaming position, in which evaporation key 122 is capable of controlling second control means 12 forcing supply of power to second heating means 4, and a delicate steam position, in which evaporation key 122 cannot control second control means 12 for supplying power to second heating means 4. The first position is intended for steam ironing of difficult fabrics, while the second position is intended for steam ironing delicate fabrics.

Preferably, selector 21 in the delicate steam position limits the path of evaporation key 122. This arrangement permits, on the one hand, limiting the opening orifice 19 and, at the same time, the quantity of water admitted into evaporation chamber 2, and, on the other hand, prevents actuation of second control means 12. Preferably, selector 21 ion the drive ironing position blocks shaft 20, directly or through the intermediary of evaporation key 122, to prevent the admission of water into evaporation chamber 2.

The invention equally concerns a regulation process for an electric steam pressing iron, comprising a hot part having a sole plate 1 and an evaporation chamber 2, the hot part of the iron being divided into two thermal zones, a first zone corresponding substantially to evaporation chamber 2 being provided with first heating means 3, a second zone corresponding substantially to a portion of sole plate 1 disposed under evaporation chamber 2 being provided with a second heating means 4, first heating means 3 being associated with a regulation device 5 disposed in said first zone, first heating means 3 being provided to partially assure heating of the second zone, regulation process in which first heating means 3 and second heating means 4 are regulated by regulation device 5 disposed in the first zone.

Numerous improvements can be provided to this appliance in the framework of the claims.

Possibility of Industrial Application

The invention finds its application in the technical field of electric steam pressing irons.

What is claimed is:

1. An electric steam pressing iron, comprising a hot part composed of a sole plate (1) and an evaporation chamber(2), the hot part of the iron being divided into two thermal zones, a first zone corresponding substantially to the evaporation chamber (2) being provided with first heating means (3), a second zone corresponding substantially to a portion of the sole plate (1) disposed under the evaporation chamber (2) being provided with second heating means (4), the first heating means (3) being associated with a thermostatic regulation device (5) disposed to be responsive to a temperature in said first zone, the first heating means being provided to partially assure the heating of the second zone, characterized in that said steam iron further comprises circuit means electrically coupling said thermostatic regulation device (5) to said first heating means (3) and to said second heating means (4).

2. Pressing iron according to claim 1, characterized in that the second heating means (4) are formed by a flat heating element (6).

3. Pressing iron according to claim 1, characterized in that the first heating means (3) are formed by a tubular heating element (7).

4. Pressing iron according to claim 3, characterized in that the tubular heating element (7) has two substantially parallel branches (8, 9) between which substantially extends the flat heating element (6).

5. Pressing iron according to claim 1, characterized in that the first heating means (3) and the second heating means (4) are mounted in parallel.

6. Pressing iron according to claim 1, characterized in that it includes first control means (11) provided to short circuit the second heating means (4).

7. Pressing iron according to claim 1, characterized in that it comprises second control means (12) provided to force the supply of power to the second heating means (4).

8. Pressing iron according to claim 6, characterized in that it comprises an ironing selector (21) provided to cooperate with the first control means (11) and capable of occupying an ironing position in which the second heating means (4) are short circuited.

9. Pressing iron according to claim 7, characterized in that it comprises an evaporation key (22) provided to control the opening of an orifice (19) placing a water reservoir (18) in communication with the evaporation chamber (2), said key being provided to cooperate with the second control means (12) to force the supply of power to the second heating means (4).

10. A regulation process for an electric steam pressing iron, comprising a hot part having a sole plate (1) and an evaporation chamber (2), the hot part of the iron being divided into two thermal zones, a first zone corresponding substantially to the evaporation chamber (2) being provided with first heating means (3), a second zone corresponding substantially to a portion of the sole plate (1) disposed under the evaporation chamber (2) being provided with second heating means (4), the first heating means (3) being associated with a thermostatic regulation device (5) disposed to responsive to a temperature in said first zone, the first heating means (3) being provided to partially assure the heating of the second zone, said process comprising regulating the first heating means (3) and the second heating means (4) by the thermostatic regulation device (5) in response to the temperature the first zone.

* * * * *